United States Patent [19]

Soo

[11] 4,004,896

[45] Jan. 25, 1977

[54] PRODUCTION OF WATER GAS

[75] Inventor: Shao L. Soo, Urbana, Ill.

[73] Assignee: University of Illinois Foundation, Urbana, Ill.

[22] Filed: Nov. 21, 1974

[21] Appl. No.: 525,955

[52] U.S. Cl. ..... 48/202; 48/197 R; 48/206; 48/210; 252/373

[51] Int. Cl.[2] ..... C10J 3/00

[58] Field of Search ..... 48/204, 210, 202, 206, 48/197 R; 252/373

[56] References Cited

UNITED STATES PATENTS

| | | | |
|---|---|---|---|
| 2,657,501 | 11/1953 | Mayland | 48/206 |
| 2,714,059 | 7/1955 | Bearer | 48/197 R |
| 3,787,193 | 1/1974 | Seglin et al. | 48/204 |

OTHER PUBLICATIONS

Goldstein, "Synthesis and Reactions of Carbon Monoxide–Hydrogen Mixtures," Petroleum Chem. Ind.

*Primary Examiner*—Robert L. Lindsay, Jr.
*Assistant Examiner*—George C. Yeung
*Attorney, Agent, or Firm*—Mason, Kolehmainen, Rathburn & Wyss

[57] ABSTRACT

A source of carbon, such as coal, is reacted with excess steam in an amount of about 2 to 10 times the amount necessary for complete reaction with the carbon source so that the steam reactant is the only source of heat necessary to supply the entire heat of reaction. The steam is superheated in a separate vessel in such a manner that it does not contain oxygen, nitrogen or combustion products so that pollutant gases are not found in the reaction product gas since the carbon source never comes in contact with oxygen in the reactor.

18 Claims, 4 Drawing Figures

PRODUCTION OF WATER GAS

BACKGROUND OF THE INVENTION

1. Field of the Invention

This invention relates to the production of hydrogen and carbon monoxide by reacting a source of carbon with steam at a high temperature. More particularly, this invention relates to the production of hydrogen and carbon monoxide by reacting coal with steam wherein the heat of reaction is provided substantially completely by the steam reactant.

The increase in cost and short supply of petroleum in recent years has made coal gasification a viable alternative for providing fuel. One of the problems associated with the use of coal itself as a fuel is that much of the coal mined contains a high amount of sulfur. Sulfur oxide pollution control regulations prohibit the emission of more than 1.2 pounds of sulfur dioxide per million BTU's of heat generated by the burning of coal. In coal gasification, however, the sulfur can be easily removed from the product gas so that a plant utilizing the water gas as a source of fuel will not ordinarily require expensive and sophisticated pollution control apparatus to meet regulations.

An economically feasible coal gasification plant for the purpose of supplying fuel to industrial and utility consumers can (1) provide enough fuel to make the United States energy self-sufficient, (2) satisfy air pollution control regulations, and (3) revitalize the coal mining industry in the high-sulfur bituminous coal districts.

2. Prior Art

The "water gas" reaction is the reaction of a carbonaceous solid with steam at high temperature to produce hydrogen and carbon monoxide and has been practiced for many years. The water gas reaction is endothermic, requiring a substantial amount of heat for reaction. One method currently used for providing the heat of reaction is to provide fuel and oxygen for combustion within a gasification reactor. A number of difficulties are encountered with this method. The hot combustion gases, principally $CO_2$, are entrained with the product gas, in addition to any gases which may accompany the oxygen, such as nitrogen. The product gases are diluted with these undesirable entrained gases, causing considerable difficulty and expense in recovering the hydrogen and carbon monoxide. Further, sulfur and other impurities may accompany the carbonaceous solid and are oxidized in the combustion reaction to sulfur oxides and other undesirable gaseous products of combustion. These oxides must also be separated from the product gas.

One attempt to solve the problem of dilution of the water gas with undesirable entrained gases is disclosed in the Seglin et al., U.S. Pat. No. 3,787,193. As set forth in the Seglin et al. patent, molten slag can be provided in the gasification reactor to supply the necessary heat for the water gas reaction, thereby eliminating the need for combustion within the gasification reactor. In the Seglin et al. process, a separate heating section is provided for producing the molten slag so that the slag can be conveyed to the gasification reactor substantially free of oxidizing gas. In this manner, combustion gases are not entrained with the products of the water gas reaction.

Another method of preventing the dilution of the product gas with the combustion products is by indirectly heating the carbonaceous solid in a fluidized bed heat exchanger so that the hot combustion gases are not intermingled with the fluidized bed of carbon. One form of this process is disclosed in the Atwell, U.S. Pat. No. 2,680,065.

SUMMARY OF THE INVENTION

It has been found that by providing excess steam in an amount and at a temperature sufficient to provide the necessary heat of reaction between a carbonaceous solid and steam, the water gas reaction can be carried out without supplying another heating source.

An object of the present invention is to provide a new and improved process for producing synthetic gas by the reaction of carbon with steam.

Another object of the present invention is to provide a process for producing synthetic gas containing as much as 90% hydrogen by the reaction of carbon with an excess of superheated steam.

Another object of the present invention is to provide a process for producing synthetic gas by reacting carbon with superheated steam and providing the heat of reaction substantially completely by the heat from the steam reactant.

Another object of the present invention is to provide a process for producing synthetic gas containing predominantly hydrogen and carbon monoxide in a desired ratio.

Another object of the present invention is to provide a process for producing synthetic gas having a desired ratio of hydrogen to carbon monoxide such that the synthetic gas so produced is suitable for further processing, such as conversion to methane, methanol, ammonia, hydrazine, or liquid fuels by hydrogenation.

Another object of the present invention is to provide synthetic gas containing hydrogen and carbon monoxide wherein the ratio of hydrogen to carbon monoxide can be regulated by regulating the temperature and amount of excess steam supplied to the reactor.

Another object of the present invention is to provide a process for producing synthetic gas by the reaction of carbon with superheated steam wherein the superheated steam can be produced either continuously or in a batch process.

Another object of the present invention is to provide a process for producing synthetic gas by the reaction of carbon with steam wherein the amounts of reactants and the temperature and pressure of reaction can be chosen so that there is no unreacted carbon and therefore no soot or char remaining in the reaction vessel.

Another object of the invention is to provide a process for producing synthetic gas by reacting a carbon source with superheated steam in such a manner that the carbon source is never in contact with air or oxygen.

Another object of the present invention is to provide a process for producing substantially pollution free fuel gas.

Another object of the present invention is to provide a process for producing synthetic gas by the reaction of a carbon source with steam wherein enough excess steam is provided for reaction with sulfur contained in the carbon source to produce $H_2S$ for conversion to $H_2$ and S.

Another object of the present invention is to provide a process for producing synthetic gas containing primarily a mixture of hydrogen and carbon monoxide wherein the hydrogen is saturated with water vapor to prevent embrittlement of apparatus used to produce and convey the synthetic gas.

Another object of the present invention is to provide a process for producing synthetic gas by the reaction of carbon with steam wherein the condensation of excess unreacted steam from the synthetic product gas will remove flyash from the product gas.

Another object of the present invention is to provide a process for producing synthetic gas including rapid cooling of the gas formed in the gasification reactor to stabilize the equilibrium at a desired reaction product composition.

Another object of the present invention is to provide a process for producing synthetic gas wherein the process can utilize a portion of the gas so produced to fulfill all or a portion of the energy requirements of the process.

Another object of the present invention is to provide a process for producing synthetic gas wherein solid waste fuels can be used to supply at least about 30% of the energy requirements of the process.

Another object of the present invention is to provide a process for producing synthetic gas by reacting carbon from a carbon source such as coal, with steam wherein the steam reactant is substantially the only source of heat for reaction and wherein the steam is supplied at a temperature below the ash fusion temperature to prevent ash clinkering, and the steam is supplied in a quantity sufficient for reaction of substantially all the carbon from the carbon source.

It is an important feature of the present invention to provide an excess of steam in amounts up to 2–10 times the amount required for reaction with carbon in a gasification reactor. In this manner, the equilibrium reaction can be shifted in favor of the production of hydrogen so that the product gas can contain as much as 90% hydrogen or more after removal of carbon dioxide and hydrogen sulfide. By providing the steam as the source of heat, the excess steam provides enough heat for reaction in addition to favorably shifting the equilibrium reaction toward production of hydrogen. Prior art processes using a heating source other than the steam reactant do not generally provide an excess of steam or such processes make the excess nominal, since the excess steam requires additional heating, making the process inefficient. In this invention, the steam reactant is the source of heat for the reaction and therefore efficiently can be provided in excess.

A further advantage of providing excess steam as the source of heat for reaction is that the coal can be fully reacted without any soot or char remaining in the gasification reactor to provide a product gas having a high ratio of hydrogen to carbon monoxide. Further, since the hydrogen in the product gas is saturated with water vapor provided by the excess steam reactant, the hydrogen will not cause embrittlement of the steel apparatus and conduits.

Another advantage of providing steam in excess is that enough excess steam can be provided for the heat of reaction of substantially all the carbon while maintaining the temperature of steam below the ash fusion temperature (about 2200° F.). In this manner ash clinkering will never become a problem in the gasification reactor.

The ratio of hydrogen to carbon monoxide in the product gas can easily be adjusted by regulating the amount and temperature of excess steam in the gasification reactor. Regulation of the amount and temperature of the excess steam will determine the temperature of the product gas as it emerges from the gasification reactor (quenching temperature). The gas produced in the gasification reactor can be cooled to condense the excess steam and then further treated to remove carbon dioxide and hydrogen sulfide, leaving a product gas of hydrogen and carbon monoxide.

When a pebble heater is used for superheating steam, air can be used as the source of oxygen for combustion to provide hot gas for heating the pebbles without diluting the superheated steam with nitrogen or combustion products.

In cases where the product gas is to be converted to methane, it is desirable to provide a molar ratio of hydrogen to carbon monoxide of about 3 to 1 in accordance with the equation $3H_2 + CO \rightarrow CH_4 + H_2O$. By adjusting the amount and temperature of the excess steam reactant, this ratio easily can be provided. By providing the product gas with a molar ratio of hydrogen to carbon monoxide of about 2 to 1, the product gas easily can be converted to methanol in accordance with the equation: $2H_2 + CO \rightarrow CH_3OH$. By reacting with a substantial excess of steam, in accordance with the process described herein, the product gas will have a molar ratio of hydrogen to carbon monoxide of more than 9 to 1. Such high ratios of hydrogen to carbon monoxide are advantageous in converting the product gas into ammonia, hydrazine, and for hydrogenating with the product gas for conversion to liquid fuels.

DETAILED DESCRIPTION

Figure 1:
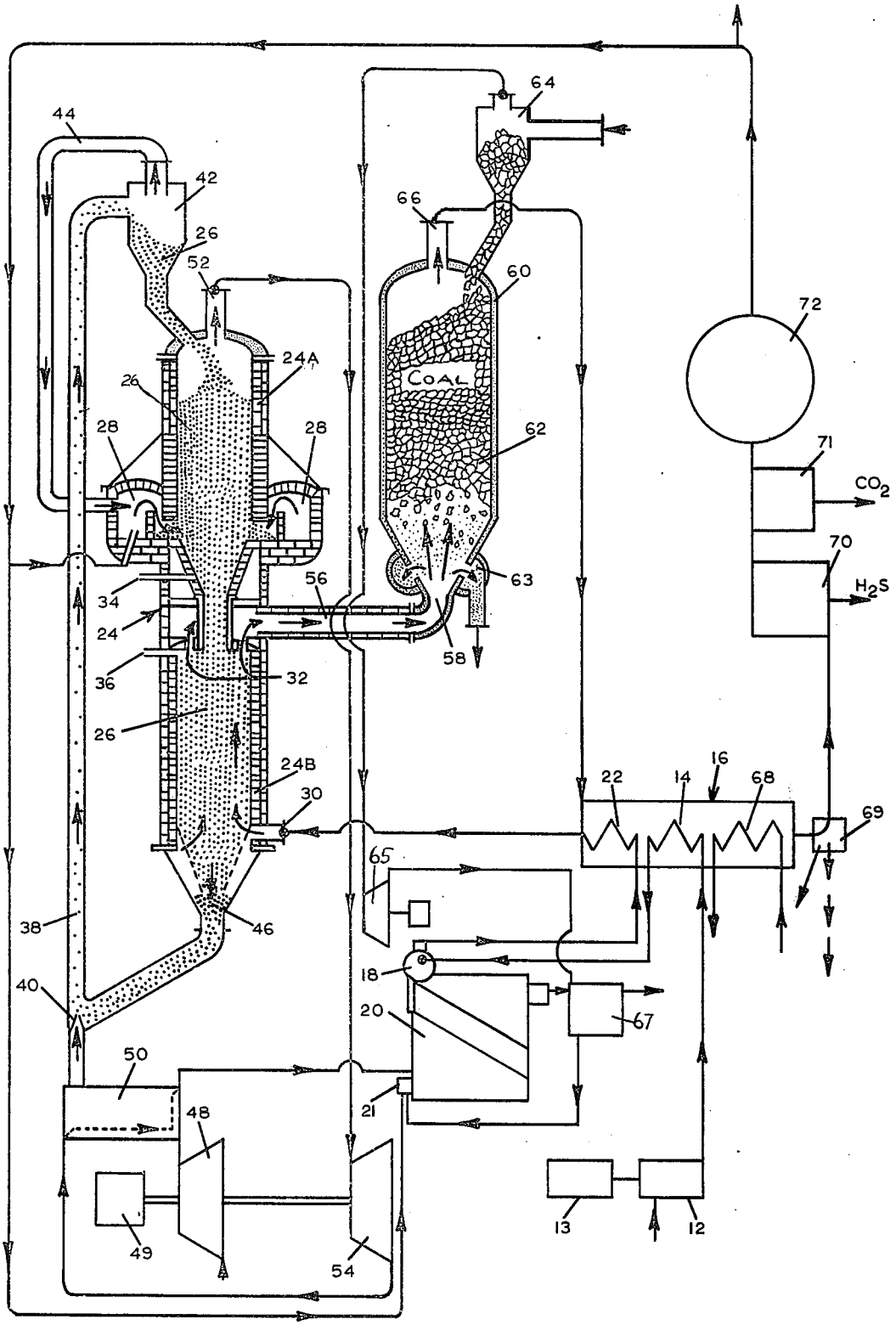
FIG. 1 is a schematic drawing illustrating a continuous process scheme according to the present invention.

The well known water gas reaction of carbon with steam is based on the following equations:

$$C + H_2O \rightarrow CO + H_2 - 56{,}520 \text{ BTU/lb. mole carbon,}$$

and $$C + 2H_2O \rightarrow CO_2 + 2H_2 - 38{,}830 \text{ BTU/lb. mole carbon.}$$

It has been found that by supplying superheated steam in excess over the amount necessary for reaction with the coal, that the entire heat of reaction for the above water gas reaction of carbon and steam can be supplied from the steam reactant while shifting the equilibrium toward greater percentages of hydrogen and carbon monoxide in the product gas.

In prior art coal gasification processes, the steam reactant is not provided at a temperature or in an amount sufficient to provide the entire heat of reaction for the above water gas reactions. Instead, another source of heat is provided to supply the heat of reaction. It is therefore undesirable in these prior art processes to provide steam in any great excess because the excess steam will necessitate an increased heat input caused by the heating of the excess steam in the gasification reactor.

The gasification process described herein provides steam at a temperature greater than the temperature of reaction of carbon with steam so that the steam acts both as a reactant and as a heat source to supply the heat of reaction. By providing an excess of steam in an amount of about 2 to 10 times that necessary for complete reaction with the carbon, the equilibrium reaction will shift toward a greater production of hydrogen and carbon monoxide in the product gas. The steam is preferably supplied in an amount of about 4–7 times that necessary for reaction with the carbon. The high temperature product gas from the gasification reactor, including the excess steam, is useful in heating the feed water and in providing some of the heating requirement for superheating the steam admitted to the gasification reactor. Further, the excess steam easily can be separated from the product gas by condensation. The condensation of the excess steam from the product gas advantageously washes away fine flyash from the product gas leaving the gas free from ash. By quenching the product gas at a given temperature, the equilibrium reaction can be stabilized at a desired ratio of hydrogen to carbon monoxide.

In the process described herein, coal or carbon never comes into direct contact with air or oxygen. In this process, air is used in combustion for producing the superheated steam, but the air never comes into contact with the coal. This prevents nitrogen and combustion products from being present in the fuel gas produced. The fuel gas can also be produced in the proper proportion of hydrogen and carbon monoxide for direct methanation, thus producing a high BTU gas without ever using pure oxygen.

It is an important feature of the present invention to superheat steam to a temperature greater than the temperature of reaction of carbon with steam without diluting the steam with nitrogen or combustion products. In this manner, diluting gases such as nitrogen as well as polluting combustion products such as sulfur oxides and nitrogen oxides do not form a part of the product gas. One method of superheating steam in this manner is by heating an inert heat transfer material in one vessel and by superheating the steam by contact with the heated inert material in another vessel, while maintaining gaseous separation between the two vessels. This is accomplished by the use of a pebble heater as well known in the art of air and steam heating, and as fully set forth in *Steam, its Generation and Use*, The Babcock and Wilcox Co. New York (1955) pp. 11–19. A description of a pebble heater is also set forth by W. L. Nelson in *Petroleum Refinery Engineering*, McGraw Hill (1949), pp. 528, 529. As set forth in *Steam, Its Generation and Use*, various suitable materials may be used as the heat transfer medium such as mullite (72% $Al_2O_3$, 28% $SiO_2$) or magnesia pebbles. Preferred is mullite pebbles about ¼ inch to ½ inch in diameter. Another method of superheating steam without diluting the steam with nitrogen or combustion products is by using a ceramic rotary heat recuperator such as a Ljungstrom heater, as described in Perry's *Chemical Engineers' Handbook*, fourth edition at pages 9–63 and 9–64.

Coal containing a high sulfur content (greater than 5% by weight) can be advantageously used as the carbon source when reacted with an excess of steam as described herein. The sulfur from the coal will react with the excess steam to form hydrogen sulfide. The hydrogen and sulfur each can be recovered by known methods. The hydrogen recovery from the $H_2S$ formed in the gasification reaction by reaction of excess steam with high sulfur coal can increase the amount of product gas formed by at least two percent and will further increase the molar ratio of hydrogen to carbon monoxide.

CONTINUOUS PROCESS — FIG. 1

Feed water is delivered by feed pump 12 powered by motor 13 into the feed heater section 14 of product gas cooler 16. In the feed heater 14, the feed water is heated by the product gas. From the feed heater 14, the water is pumped to a boiler drum 18 of boiler 20 where the heated water is converted to steam. From the boiler 20, the steam is conveyed to the superheater section 22 of product gas cooler 16 where the steam is superheated before being conveyed to heater 24.

Heater 24 comprises two chambers, a pebble heater chamber 24A and a steam superheater chamber 24B, chamber 24A disposed above chamber 24B. A suitable heat transfer medium, such as a plurality of refractory pebbles are admitted to the pebble heater chamber 24A of the heater 24 where the pebbles 26 are heated by direct contact with burning fuel in air from burner 28. A preferred heat transfer medium is mullite (72% $Al_2O_3$, 28% $SiO_2$) pebbles, about ¼ to ½ inch in diameter. The combustion gases flow upwardly in countercurrent flow to the incoming pebbles 26. The hot pebbles flow downward to the steam superheater chamber 24B countercurrently to the flow of incoming steam from the superheater section 22 of product gas cooler 16.

Steam from superheater 22 enters the steam superheater chamber 24B of heater 24 at steam inlet 30 and passes upwardly while being superheated by pebbles 26 and leaves the steam superheater chamber 24B through steam outlet 32 after being heated to approximately 3000° F. By suitably adjusting pressure control 34 in the pebble heater chamber 24A and pressure control 36 in the steam superheater chamber 24B, it can be assured that the combustion gases in upper chamber 24A pass upwardly and do not enter lower chamber 24B. To assure that no combustion products enter steam superheater chamber 24B a slight leak of steam is allowed from superheater chamber 24B into pebble heater chamber 24A by raising the pressure in the superheater chamber 24B slightly above the pressure in the pebble heater chamber 24A. By adjusting pressure controls 34 and 36 it can be assured that substantially all of the superheated steam will pass through steam outlet 32, maintaining gas separation between pebble heater chamber 24A and steam superheater chamber 24B.

Mullite pebbles 26, after being cooled by giving up heat in superheating the steam, flow into an elevator conduit 38 where heated compressed air passing through nozzle 40 lifts the pebbles to a cyclone 42 where the heated air is separated from the pebbles 26. The heated air used for lifting the pebbles from the outlet 46 of lower chamber 24B to the cyclone 42 is compressed in compressor 48 driven by motor 49 and heated in heat exchanger 50. It is advantageous to use some of the hot combustion gases from pebble heater chamber 24A as a source of heat to heat the air in heat exchanger 50. The heated separated air from cyclone 42 is directed into burner 28 by conduit 44 and the pebbles 26 drop into pebble heater section 24A. The heated separated air from cyclone 42 is directed into burner 28 where it combines with product fuel gas to burn the fuel gas and raise the temperature of the pebbles 26 to about 3500° F. It is important that the air and combustion products in pebble heater chamber 24A never contact the carbon source. Solid waste fuel, such as combustible garbage can be used in burner 21 in an amount up to about 30% of the fuel requirements in burner 21 to achieve a higher efficiency.

The hot gas produced in burner 28 contacts pebbles 26 in pebble heater 24A to raise the temperature of the pebbles to about 3500° F. and cool the combustion gases to about 1200° F. before leaving the pebble heater at combustion gas outlet 52. The cooled combustion gases are conducted through turbine 54 to heat exchanger 50 where the combustion gases heat the compressed air from compressor 48 used in raising the pebbles to cyclone 42.

The superheated steam from steam superheater chamber 24B is conveyed through conduit 56 into a gasification reactor 60 at inlet 58. In the gasification reactor 60, the superheated steam is used both as a heat transfer medium and as a reactant with coal 62. A substantial excess of steam is provided into gasification reactor 60 so that sufficient heat is provided for reaction of the coal with the steam and so that the equilibrium of the reaction will favor the production of hydrogen and carbon monoxide.

It is an important feature of the heater 24 that the pebble heater chamber 24A and the steam superheater chamber 24B do not allow any substantial gaseous interchange and that no gas from chamber 24A is allowed to pass into chamber 24B. The superheated steam produced in the steam superheater chamber 24B cannot be intermingled with combustion gases from pebble heater chamber 24A and cannot be diluted by nitrogen or any other undesirable constitutents contained in the combustion gases of pebble heater 24A. It is important that steam be substantially the only heat transfer medium in gasification reactor 60 to minimize the formation of undesirable gases in the gasification reactor 60. The heater 24 provides combustion to heat pebbles 26 for effective and efficient heat transfer in superheating steam in superheater chamber 24B without the entrainment of undesirable gases into gasification reactor 60.

Coal is admitted to gasification reactor 60 by pumping the coal with air through cyclone 64. The air from cyclone 64 is directed into turbine 65 where the power from the air can be recovered for driving a generator (not shown) or for driving an air blower to furnish additional air through heat exchanger 67, to boiler 20. In the gasification reactor 60, the coal 62 reacts with the superheated steam forming reaction products comprising predominantly hydrogen and carbon monoxide. Ash is collected in hopper 63 at the bottom of the gasification reactor 60. The product gases flow through outlet 66 of gasification reactor 60 and are directed into a product gas cooler 16 where the heat from the product gas is recovered by superheating steam in superheater section 22 and by heating the feed water in feed heater section 14. The product gases are then condensed in condenser section 68 of product gas cooler 16 to remove a substantial portion of the excess steam contained in the product gas. Impurities condensed with the excess steam in condenser section 68 are removed in trap 69. The cooled product gases from the product gas cooler 16 are directed into a hydrogen sulfide recovery process 70, for example, a typical girbotol assembly, and the product gas, after hydrogen sulfide removal, is directed into a $CO_2$ removal process 71, for example, a typical monoethanolamine absorption process. The product gas is then directed into storage vessel 72. Some of the gas so produced is used in the burner section 28 of pebble heater 24A and some of the product gas is used for the fuel requirements in boiler 20. If economically available, solid waste fuels can be used to supplement burner section 21 and boiler 20 in addition to the use of product gas. The entire plant is relatively pollution free.

BATCH PROCESS — FIGS. 2 & 3

Figure 2:
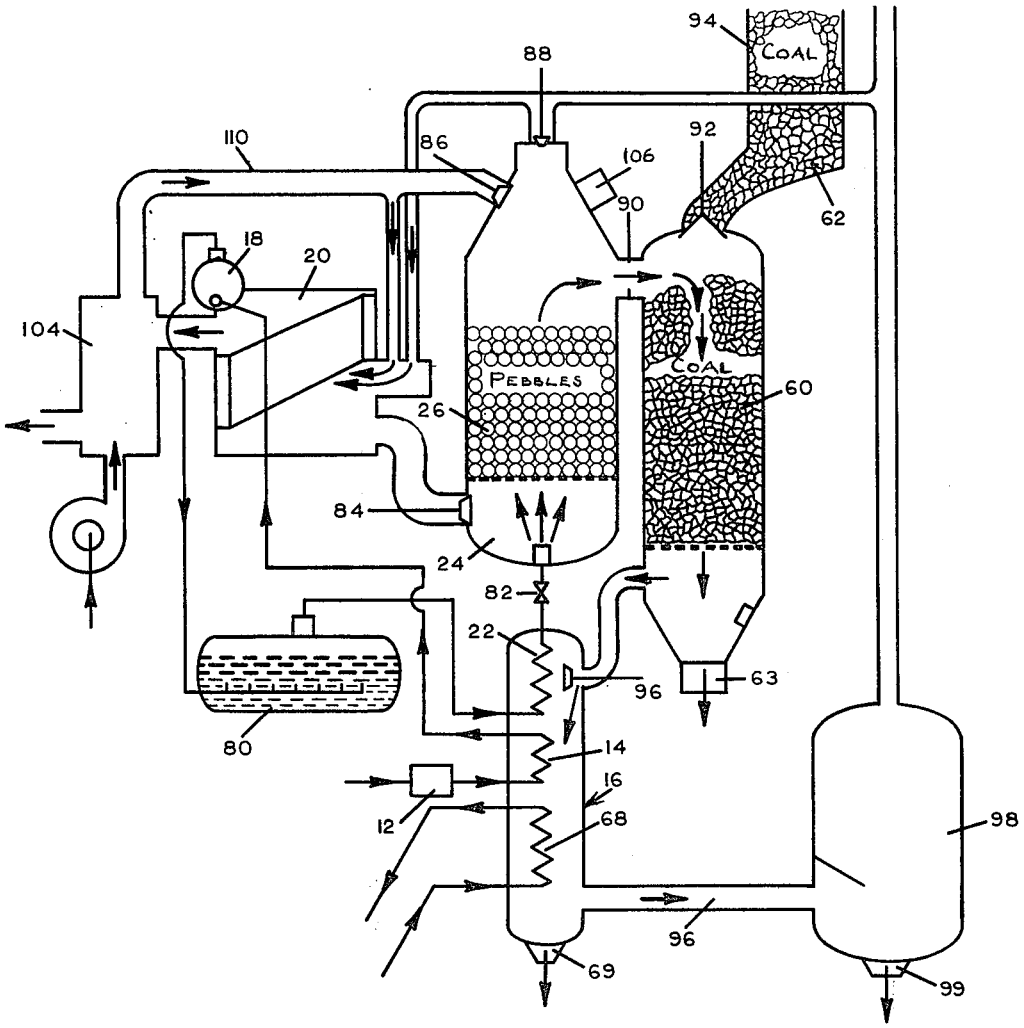
FIG. 2 is a schematic drawing illustrating a batch process scheme according to the present invention.

Gasification — FIG. 2

Water is pumped by feed pump 12 into the feed heater section 14 of product gas cooler 16. In feed heater 14, the feed water is heated by the product gas from gasification reactor 60. From the feed heater 14, the heated water is pumped to a boiler drum 18 of boiler 20 where the heated water is converted to steam. From the boiler 20, the steam is fed into an accumulator 80 where the steam pressure builds up to a desired value. Steam is conveyed from accumulator 80 through the superheater section 22 of product gas cooler 16 by opening valve 82 disposed between the superheater section 22 of product gas cooler 16 and heater 24. In the superheater section 22, steam is superheated by indirect contact with the hot product gas from gasification reactor 60. From the superheater section 22 of product gas cooler 16, the superheated steam is directed into heater 24 where the steam contacts the heated pebbles 26 to superheat the steam to about 3000° F. The heating of the pebbles 26 is carried out as a separate step, described with reference to FIG. 3.

During the superheating of the steam in heater 24 valves 84, 86, and 88 are closed and valve 90 is opened to permit the superheated steam to pass into gasification reactor 60. Valve 92 is closed after coal 62 from the coal hopper 94 has been charged into gasification reactor 60. Before any appreciable amount of reaction in the gasification reactor 60, valve 96 is closed. When the pressure within gasification reactor 60 builds up to a predetermined value as a result of the production of fuel gas, valve 96 opens permitting the hot product gas to pass through product gas cooler 16, first through superheater section 22, then through feed water heater 14, and finally through condenser section 68. Ash is collected at the bottom hopper 63 of gasification reactor 60. Impurities condensed with the steam in condenser section 68 are collected in trap 69 at the bottom of product gas cooler 16. From the product gas cooler 16, the cooled product gas flows through a conduit 96 to a gas storage vessel, 98. The $H_2S$ and $CO_2$ in the product gas can be removed with any known purification processes at any point after the product gas leaves product gas cooler 16. This can be done either before or after storage in storage vessel 98, preferably before storage.

Figure 3:
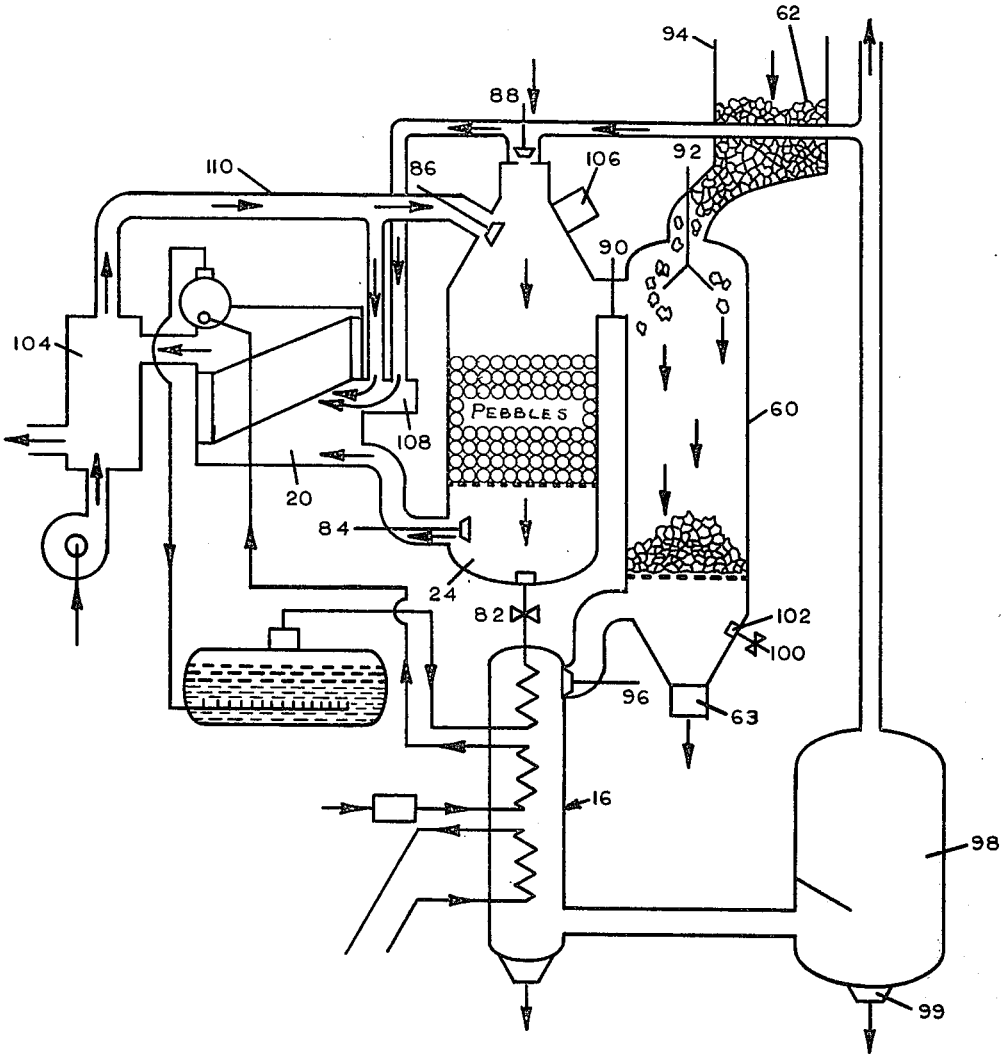
FIG. 3 is a schematic drawing illustrating a batch process scheme for pebble heating according to the present invention.

Pebble Heating — FIG. 3

To heat pebbles 26 in heater 24, valve 82 is closed to prevent steam from entering heater 24. Since the coal in gasification reactor 60 has been consumed from the previous gasification run, water vapor fills heater 24 and gasification reactor 60. Valve 96 is closed by the build-up of pressure in product gas cooler 16. Valve 100 in gasification reactor 60 is now opened to inject enough water from feed pump 12 through the nozzel 102 to reduce the pressure in heater 24 and gasification reactor 60 to near atmospheric. Valve 90 between heater 24 and gasification reactor 60 is then closed and valves 84, 86 and 88 are opened. Preheated air from heat exchanger 104 is admitted to heater 24 through valve 86, and product gas from storage vessel 98 is admitted to heater 24 through valve 88. Combustion is then initiated in heater 24 to heat pebbles 26. While the pebbles 26 are being heated by combustion in heater 24, gasification reactor 60 can be prepared for the next successive gasification run. The ash collected in hopper 63 can be removed and the coal 62 reloaded by opening valve 92 to permit coal 62 to be charged from hopper 94 to gasification reactor 60.

The plant operation can be started by providing auxiliary fuel such as oil or gas supplied through fuel inlet 106 in the heater 24 and auxiliary fuel inlet 108 in boiler 20.

PREFERRED EMBODIMENTS

Continuous Process — FIG. 1

It is preferred to gasify coal continuously, as shown in FIG. 1, using a line pressure of about 200 p.s.i. and superheated steam at about 3,000° F. at the inlet to the coal gasification reactor 60. The following flow rate parameters are for a plant having a capacity of about 540 tons per day of coal. These flow rates can be modified for any desired plant capacity. Referring now to FIG. 1, water is pumped at the rate of 740 gallons per minute by pump 12 through feed heater 14. From the feed heater 14, the water is pumped to a boiler drum 18 of boiler 20 where all of the feed water is converted into steam at a pressure of 200 p.s.i. From the boiler 20 the steam at 200 p.s.i. is fed into the superheater section 22 of product gas cooler 16 where the 200 p.s.i. steam is superheated to about 1200° F. The 1200° F., 200 p.s.i. steam is fed into the steam superheater chamber 24B of heater 24, flowing countercurrently to the downward flow of heated pebbles 26, and the steam is heated to approximately 3,000° F. before flowing through steam outlet 32 and into conduit 56. The 3,000° F. steam at about 200 p.s.i. flows into inlet 58 of gasification reactor 60. Coal is charged to gasification reactor 60 at a rate of about 49,333 pounds per hour thereby providing 1 pound mole of coal for each 5 pound moles of steam in the gasification reactor. The steam gives up heat in the gasification reactor 60 thereby providing the heat for reaction between the steam and the carbon of the coal. The product gas leaving the gasification reactor 60 through outlet 66 comprises mainly hydrogen, carbon monoxide some carbon dioxide and excess steam and contains some hydrogen sulfide. The product gas leaves reactor 60 at a quenching temperature of about 1500° F., at a pressure of about 200 p.s.i. and is directed into product gas cooler 16. Cooling water is provided in the condenser section 68 of product gas cooler 16 at a rate of about $10^4$ gallons per minute to condense the steam out of the product gas. Approximately 600 gallons per minute of water condensate is recovered in trap 69 before the product gas is sent to hydrogen sulfide and carbon dioxide removal processes 70 and 71. The product gas is stored in storage vessel 72 at a pressure of about 195 p.s.i. The product gas so produced is obtained at a rate of $3.89 \times 10^4$ s.c.f.m. From this product gas, approximately 23,500 s.c.f.m. is used for combustion in burner 28 and in burner 21 of the boiler 20. The net production of hydrogen and carbon monoxide is therefore 15,400 s.c.f.m.

EXAMPLE — BATCH PROCESS

Referring to FIG. 2, feed water is pumped at a rate of 740 gallons per minute to 600 p.s.i. by pump 12 and through feed heater section 14 of product gas cooler 16 where the feed water is heated to 460° F. The heated feed water is pumped to boiler drum 18 of boiler 20 where steam at 560 p.s.i. is produced. From the boiler 20, the steam is fed into accumulator 80 where the steam is held at 550 p.s.i. and 477° F. From the accumulator 80, the steam is sent to the superheater section 22 of product gas cooler 16 where the steam is superheated to 1200° F. and sent into heater 24 through valve 82. The heater 24 is a vessel having a diameter of 20 feet and having a height of 40 feet and contains 50 tons of refractory pebbles heated to about 3500° F. (heated in accordance with the process described with reference to FIG. 3). Coal is fed into gasification reactor 60 from coal hopper 94 at the rate of about 23 tons per hour. In the gasification reactor 60, steam at 3,000° F. from heater 24 contacts the coal and reacts therewith to form a product gas containing hydrogen, carbon monoxide, carbon dioxide, unreacted steam and some hydrogen sulfide. The product gas leaves the gasification reactor 60 at about 1500° F. and 525 p.s.i. Ash from the gasification reactor 60 is collected in hopper 63. The product gas passes through the product gas cooler 16, first passing through superheater section 22, then through the feed heater 14 and finally through the condenser section 68. In the condenser section, the excess steam is condensed and impurities, such as flyash, serve as condensation nuclei so that the flyash is removed. The water from condensation in product gas cooler 16 is collected in trap 69 at a rate of about 600 gallons per minute. This water can be sent to a water purification system and the water can thereby be reused. The product gas containing about 90% $H_2$ flows through conduit 96 at 100° F. and 500 p.s.i. to gas storage vessel 98. Further water is collected in trap 99 upon further cooling of the stored gas to ambient in storage vessel 98. Generally, this water collected in trap 99 is collected at the rate of about 20 gallons per minute until the gas has cooled to ambient. The product gas from the gas storage vessel 98 is collected at the rate of about $3.89 \times 10^4$ s.c.f.m. About 15,400 cubic feet per minute of product gas having a heating value of 340 BTU/s.c.f. is the net product gas collected. The remainder of the gas, $2.35 \times 10^4$ c.f.m., is used within the system for producing steam in boiler 20 ($10^4$ c.f.m.). The net gas production can be increased by using solid waste fuels in boiler 20.

With reference to FIG. 3, the pebbles 26 in pebble heater 24 are heated to approximately 3500° F. in the following manner. Valve 90 is closed to stop the steam flow into heater 24. Valve 96 is now closed by the back pressure in product gas cooler 16. Valve 100 is opened to inject water from feed pump 12 into the gasification reactor 60 to reduce the pressure in heater 24 and gasification reactor 60 to near atmospheric. Valve 90 between heater 24 and gasification reactor 60 is then closed and valves 84, 86 and 88 are opened. Combustion is then initiated in pebble heater 24 by combusting $1.35 \times 10^4$ c.f.m. of product gas with 650° F. air from heat exchanger 104 to produce hot gases of combustion at 4500° F. These hot combustion gases heat 50 tons of pebbles in heater 24 to about 3500° F.

The two primary factors affecting the efficiency of the process described herein are the steam temperature entering heater 24 and the pressure in boiler 20. In accordance with the data set forth in Table I, the boiler pressure was selected up to 1500 p.s.i., the refractory heat transfer medium temperature, and therefore the steam temperature out of heater 24, was adjusted between 3500° F. and 4500° F. to determine various efficiencies with the different combinations of boiler pressures and steam temperatures. As seen by the data in Table I, the higher boiler drum pressure and higher steam temperature is most efficient. By utilizing solid waste in boiler 20, this efficiency of 83% can be further increased to 86% or higher.

TABLE I

| | | | | |
|---|---|---|---|---|
| Boiler pressure, psi | 500 | 500 | 1500 | 1500 |
| max. pebble temp. ° F | 3500 | 4500 | 3500 | 4500 |
| Steam flow, (water gpm) | 740 | 420 | 740 | 420 |
| Water consumed, gpm | 120 | 120 | 120 | 120 |
| Cooling water, gpm 40° F. temp. rise | 10000 | 5700 | 10000 | 5500 |
| Net output, scfm | 15400 | 20400 | 18400 | 21900 |
| Efficiency, % | 58 | 77 | 69 | 83 |

EQUILIBRIUM

In accordance with the process set forth herein, there are basically five reaction products: hydrogen, carbon monoxide, carbon dioxide, excess steam, and unreacted carbon. The equilibrium equation can be set forth as follows:

$$C + a_0H_2O \rightleftarrows a_1CO + a_2CO_2 + a_3H_2 + a_4H_2O + a_5C$$

wherein $a_0$=moles of steam/mole of carbon initially charged to the gasification reactor, $a_1$=moles of carbon monoxide/mole of original carbon, $a_2$=moles of carbon dioxide/mole of original carbon, $a_3$=moles of hydrogen/mole of original carbon, $a_4$=moles excess or unreacted steam/mole of original carbon, $a_5$=moles unreacted carbon/mole of original carbon.

There are three basic equilibrium equations involved in the water gas reaction. These basic reactions are set forth below where the equilibrium data is for 800°–1200° K; Gasification:

(1)

$$C + H_2O_{(g)} \rightleftarrows CO + H_2 + 31.398 \text{ kcal/g-mole}$$

$$\log_{10} K_1 = \log_{10} (P_{CO}\, P_{H_2} / P_{H_2O}) = 7.641 - 7{,}230/T(° K)$$

(2)

$$C + 2H_2O_{(g)} \rightleftarrows CO_2 + 2H_2 + 21.57 \text{ kcal/g-mole}$$

(3)

$$CO + H_2O_{(g)} \rightleftarrows H_2 + CO_2 - 9.828 \text{ kcal/g-mole}$$

$$\log_{10} K = \log_{10} (P_{H_2}\, P_{CO_2} / P_{CO} P_{H_2O}) = -1.791 + 1{,}872/T\ (° K)$$

The equilibrium graphs (FIG. 4) have been plotted using various amounts of original steam ($a_0$) where $a_0$=1, $a_0$=2 and $a_0$=5. No excess steam represents a typical prior art process. In the process set forth herein it is advantageous to use up to five moles of steam for each mole of carbon ($a_0$=5).

Figure 4:
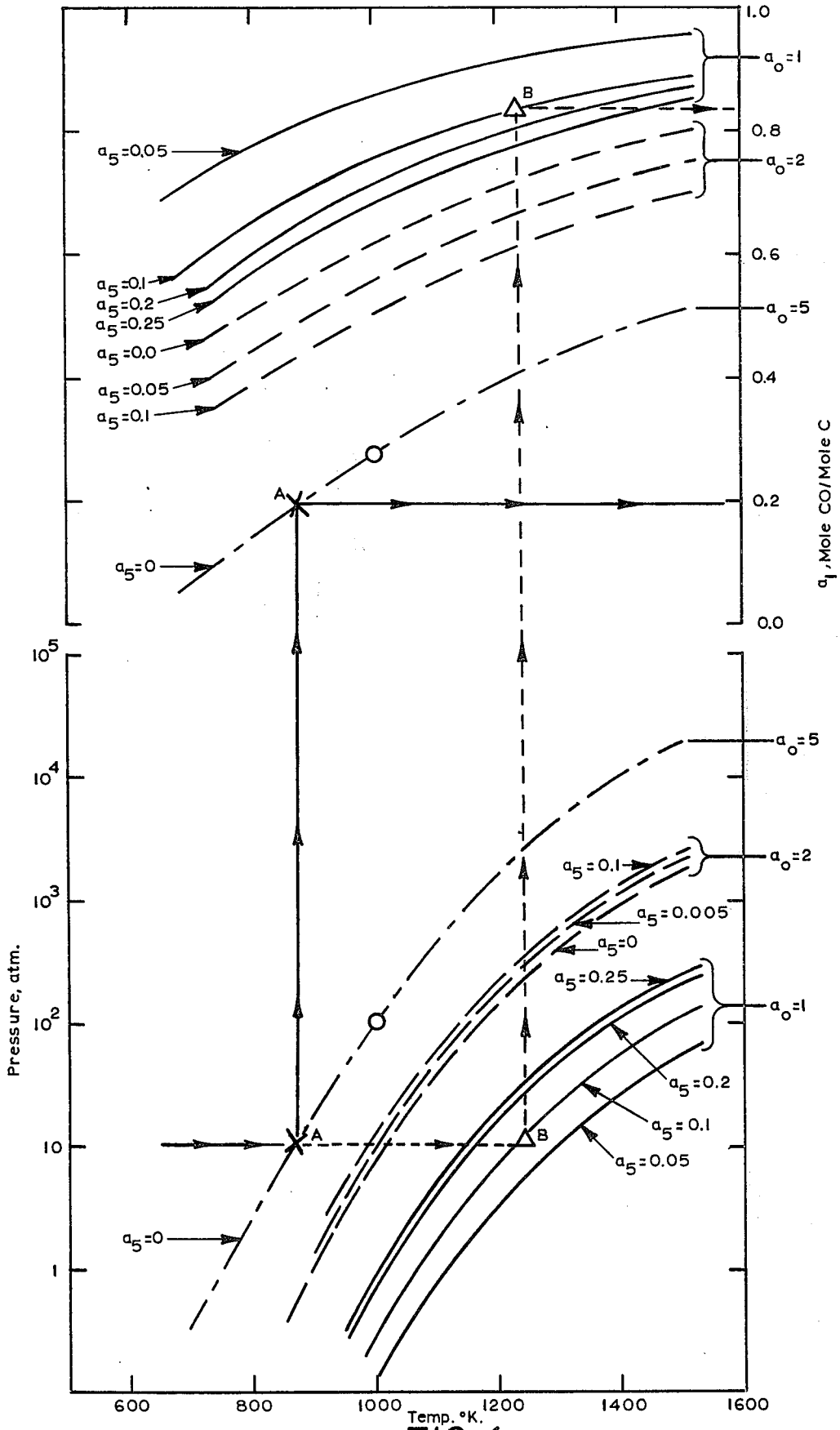
FIG. 4 shows a graphical comparison of the process of the present invention to prior art processes.

In addition to providing equilibrium data for the process described herein, FIG. 4 shows a comparison of applicant's process to typical prior art processes in which $a_0$=1. At ten atmospheres, FIG. 4 shows a comparison of the process of the present invention, where $a_0$=5 and with no char left in the reactor ($a_5$=0), to that of a prior art process where $a_0$=1 and $a_5$=0.1. Point A represents the process of the present invention and Point B represents the prior art process. At $a_5$=0, and 10 atmospheres reactor pressure, the reaction temperature for the process herein disclosed is 1120° F. whereas the reaction temperature of the prior art process ($a_0$=1) is 1740° F.

Extending point A vertically upward to the top half of the graph, the mole percentage of CO ($a_1$) for the process described herein is 0.2 whereas the mole percentage of CO ($a_1$) in the prior art process is 0.82. The process described herein therefore achieves about 90% $H_2$ and 10% CO whereas the prior art process achieves only 54.5% $H_2$ and 45.5% CO.

Six different examples of sets of design parameters have been set forth in Table II to summarize the product and energy relations of the process. Each example is based on one lb. mole of steam at the reactor inlet, 1,200° F. at the outlet to the superheater section 22 (FIG. 1), and 100° F condenser temperature:

TABLE II

| Gases | 1 | 2 | 3 | 4 | 5 | 6 |
|---|---|---|---|---|---|---|
| Design Parameters: | | | | | | |
| (1) Carbon Input, C*, lb-Mole | 0.35 | 0.35 | 0.30 | 0.25 | 0.30 | 0.25 |
| (2) Maximum Temperature, $T_r$, ° F | 3240 | 3000 | 2750 | 2500 | 2510 | 2270 |
| (3) Quenching Temperature, $T_q$, ° F | 1500 | 1300 | 1300 | 1300 | 1100 | 1100 |
| (4) System Pressure, P, atm | 10 | 10 | 10 | 10 | 3 | 6 |
| (Allowable) | (70) | (12) | (23) | (27) | (3) | (6) |
| (5) $H_2O$ Converted, lb-Mole | 0.519 | 0.548 | 0.487 | 0.421 | 0.516 | 0.444 |
| Energy Relations: | | | | | | |

TABLE II-continued

| Gases | 1 | 2 | 3 | 4 | 5 | 6 |
|---|---|---|---|---|---|---|
| (6) Heat to Pebble Heater (90% Effectiveness) $Q_H$, $10^3$ Btu | 25.20 | 21.97 | 18.63 | 15.41 | 15.53 | 12.50 |
| *(7) Net Heat to Boiler (90% Effectiveness) $Q_{ba}$, $10^3$ Btu | 12.39 | 14.98 | 15.23 | 15.49 | 17.83 | 18.01 |
| (8) Heat to Cooling Water, $Q_w$, $10^3$ Btu | 6.46 | 5.94 | 6.98 | 8.10 | 6.51 | 7.73 |
| (9) Pump Work, $w_p$, Btu | 7 | 7 | 7 | 7 | 2 | 4 |
| (10) Blower Work, $w_B$, Btu (30 inch $H_2O$ equivalent) | 28 | 27 | 25 | 23 | 8 | 14 |
| Flow Quantities: | | | | | | |
| (11) Fraction of Gas to Pebble Heater | 0.332 | 0.291 | 0.287 | 0.289 | 0.243 | 0.236 |
| (12) Fraction of Gas to Boiler* | 0.163 | 0.198 | 0.236 | 0.290 | 0.279 | 0.340 |
| (13) Moles of Air | 0.824 | 0.815 | 0.750 | 0.688 | 0.746 | 0.685 |
| (14) Moles Fuel Gas Generated | 0.354 | 0.358 | 0.286 | 0.211 | 0.287 | 0.212 |
| (15) Moles Fuel Gas (Generated with External Heat) | (0.468) | (0.496) | (0.428) | (0.356) | (0.454) | (0.382) |
| Product Compositions: | | | | | | |
| (16) Fuel Gas: CO, % | 25.8 | 21.7 | 18.8 | 15.8 | 11.2 | 11.2 |
| (17) Fuel Gas: $H_2$, % | 74.2 | 78.3 | 81.2 | 84.2 | 88.8 | 83.8 |
| (18) Moles $CO_2$ to be Absorbed | 0.196 | 0.198 | 0.187 | 0.171 | 0.216 | 0.194 |
| (19) $N_{H\ S}/N_{SO}$, $10^7$ | 0.712 | 15.9 | 9.03 | 4.76 | 403 | 202 |
| (20) $N_{H\ S}/N_{COS}$ | 91 | 114 | 137 | 169 | 195 | 250 |
| Performance Parameters: | | | | | | |
| (21) Higher Heating Value (HHV, Btu/scf) | 342 | 342 | 342 | 342 | 342 | 342 |
| **(22) Lower Heating Value (LHV), Btu/scf | 303 | 301 | 299 | 298 | 297 | 295 |
| (23) Efficiency, HHV (without External Heat), % | 733 | 74.1 | 69.2 | 61.2 | 69.4 | 61.7 |
| *(24) Efficiency, HHV (with External Heat), % | 80.2 | 92.7 | 79.6 | 75.6 | 81.3 | 77.9 |
| (25) Efficiency, LHV (without External Heat), % | 64.9 | 65.2 | 60.5 | 53.2 | 60.2 | 53.2 |
| *(26) Efficiency, LHV (with External Heat), % | 71.0 | 81.5 | 69.6 | 65.8 | 70.5 | 67.2 |
| *(27) % Waste Heat Utilizable | 17.3 | 20.2 | 23.1 | 26.8 | 26.0 | 29.9 |

For T* Tons of Coal per Day of 12,000 Btu/lb, Multiply Extensive Quantities by 0.0985 T*/C* to obtain Moles per Minute.

*May use external heat source such as solid waste; (3) External Heat Not Charged.
**Water in combustion product not condensed.

I claim:

1. In a method of producing synthesis gas by reacting carbon and steam in a reaction vessel, including introducing solid carbon and steam to said reaction vessel and supplying heat to said vessel sufficient for the reaction of said solid carbon with steam, the improvement comprising supplying superheated steam to said vessel at a temperature and in a quantity sufficient to provide the entire heat of reaction for the reaction of said carbon with a portion of said superheated steam, said superheated steam being substantially the only source of heat supplied to said carbon in said reaction vessel, and wherein said reaction vessel is substantially free from an oxygen containing gas.

2. A method of producing synthesis gas by reacting carbon with steam comprising, superheating steam to a temperature greater than the reaction temperature of carbon with steam, charging a source of solid carbon to a reactor, charging said superheated steam to said reactor in an amount of at least two times the amount necessary for complete reaction with the carbon of said carbon source, and at a temperature sufficient to provide the entire heat of reaction for the reaction of said carbon with a portion of said superheated steam, and contacting said carbon with said superheated steam to produce synthesis gas, and wherein said reaction is carried out in said reaction vessel substantially free from an oxidizing gas.

3. A method as defined in claim 2 wherein said superheated steam is at a temperature greater than about 2000° F.

4. A method as defined in claim 2 wherein said superheated steam is produced by the steps of:

heating an inert heat transfer medium to a temperature of at least that of the superheated steam produced, and contacting the heated inert heat transfer medium with $H_2O$ to produce said superheated steam.

5. A method as defined in claim 2 including heating the inert heat transfer medium in a heating vessel to produce a heated inert heat transfer medium, charging the heated inert heat transfer medium to a superheated vessel for contact with $H_2O$ to produce superheated steam, and maintaining gas separation between said heating vessel and said superheater vessel to prevent gas from said heating vessel from entering said superheater vessel and to prevent gas from said superheater vessel from entering said heating vessel.

6. A method as defined in claim 2 further including transferring heat from said product gas to $H_2O$ to thereby utilize said transferred heat in producing said superheated steam.

7. A method as defined in claim 5 wherein said inert heat transfer medium is heated by combusting fuel with oxygen to produce hot gases of combustion, and contacting said heat transfer medium with said hot gases of combustion.

8. A method as defined in claim 7 including transferring a portion of the synthetic gas produced in said reactor to said heating vessel to supply at least a portion of said fuel for combustion.

9. A method as defined in claim 5 wherein said heating vessel is disposed above with superheater vessel and interconnected thereto to permit the inert heat transfer medium to flow by gravity from said heating vessel into said superheater vessel.

10. A method as defined in claim 9 including charging $H_2O$ into said superheater vessel at a point near the bottom of the superheater vessel to cause steam to flow countercurrently to the flow of said heat transfer medium.

11. A method as defined in claim 2 including supplying about 4–7 moles of superheated steam to said reactor for each mole of carbon supplied to said reactor.

12. A method as defined in claim 1 wherein the reaction is carried out substantially free from nitrogen.

13. In a method of producing synthesis gas by reacting carbon and steam in a reaction vessel, including introducing solid carbon and steam to said reaction vessel and supplying heat to said vessel sufficient for the reaction of carbon with steam, the improvement comprising supplying a substantial excess of superheated steam to said vessel at a temperature and in a quantity sufficient to provide the entire heat of reaction for the reaction of said carbon with a portion of said superheated steam, said superheated steam being substantially the only source of heat supplied to said carbon in said reaction vessel and wherein said reaction vessel is substantially free from an oxygen containing gas.

14. In a method as defined in claim 12 wherein the steam is provided in an amount of at least two times the stoichiometric amount necessary for reaction with said carbon in said reaction vessel.

15. A method of producing synthesis gas by reacting carbon with steam comprising, superheating steam to a temperature greater than the reaction temperature of carbon with steam, charging a source of solid carbon to a reactor, charging said superheated steam to said reactor in an amount of about 2–10 times the stoichiometric amount necessary for complete reaction with the solid carbon of said carbon source, and contacting said carbon with said superheated steam to produce synthesis gas.

16. A method as defined in claim 15 including superheating said steam to a temperature greater than about 2000° F.

17. A method as defined in claim 15 including supplying said steam to said reactor substantially free from an oxidizing gas.

18. A method of producing synthesis gas by reacting carbon with steam comprising, superheating steam to a temperature greater than the reaction temperature of carbon with steam in a vessel separated from a reaction vessel used for said reaction of carbon with steam, charging a source of solid carbon to said reaction vessel, said reaction vessel being substantially free from an oxygen containing gas, charging said superheated steam to said reaction vessel at a reaction vessel inlet temperature above 1832° F and in an amount substantially more than one mole of said steam per mole of carbon of said carbon source, said superheated steam being substantially the only source of heat supplied to said carbon in said reaction vessel, and contacting said carbon with said superheated steam to produce synthesis gas entrained in excess steam.

* * * * *